US005302808A

United States Patent [19]

Sato et al.

[11] Patent Number: 5,302,808

[45] Date of Patent: Apr. 12, 1994

[54] THERMAL FIXING APPARATUS AND A HEATER THEREFOR

[75] Inventors: Shigehiro Sato, Yokohama; Yoshiyuki Matsunaga, Yokosuka, both of Japan

[73] Assignee: Toshiba Lighting & Technology, Tokyo, Japan

[21] Appl. No.: 939,038

[22] Filed: Sep. 3, 1992

Related U.S. Application Data

[63] Continuation of Ser. No. 691,846, Apr. 26, 1991, abandoned.

[30] Foreign Application Priority Data

Apr. 26, 1990 [JP] Japan ..... 2-111174

[51] Int. Cl.[5] ..... H05B 1/00; H05B 3/16

[52] U.S. Cl. ..... 219/216; 219/543

[58] Field of Search ..... 219/216, 469, 470, 471, 219/543; 355/289, 296; 346/76 PH

[56] References Cited

U.S. PATENT DOCUMENTS

| | | | |
|---|---|---|---|
| 1,093,968 | 4/1914 | Bicknell | 219/543 |
| 3,591,276 | 7/1971 | Byrne | 219/216 |
| 3,679,473 | 7/1972 | Blatchford et al. | 427/96 |
| 3,810,735 | 5/1974 | Moser | 219/216 |
| 3,864,709 | 2/1975 | Bruns | 219/216 |
| 4,417,257 | 11/1983 | Mitsui | 219/216 |
| 4,566,783 | 1/1986 | Schwierz | 219/216 |
| 4,574,292 | 3/1986 | Takikawa | 219/543 |
| 4,595,823 | 6/1986 | Sorimachi | 219/216 |

FOREIGN PATENT DOCUMENTS

| | | |
|---|---|---|
| 0125580 | 11/1984 | European Pat. Off. . |
| 3320493 | 12/1982 | Fed. Rep. of Germany . |
| 59-068766 | 4/1984 | Japan . |

*Primary Examiner*—Bruce A. Reynolds
*Assistant Examiner*—Michael D. Switzer
*Attorney, Agent, or Firm*—Cushman, Darby & Cushman

[57] ABSTRACT

A thermal fixing apparatus including a heater and a pressure roller pressed against the heater. The heater has a substrate, an electrical heating element mounted on the substrate and a protective layer covering the electrical heating element, the protective layer having a concave contacting edge. The pressure roller is fitted against the concave contacting edge of the protective layer of the heater.

12 Claims, 2 Drawing Sheets

THERMAL FIXING APPARATUS AND A HEATER THEREFOR

This is a continuation of application Ser. No. 07/691,846, which was filed on Apr. 26, 1991, which will become abandoned upon the filing hereto.

FIELD OF THE INVENTION

The present invention relates generally to a thermal fixing apparatus and a heater for use in the apparatus.

BACKGROUND OF THE INVENTION

In a conventional image forming apparatus, such as electric copying equipment, facsimile equipment, etc., a thermal fixing apparatus is used for fixing a toner image developed on a paper for copying to the paper.

In a conventional thermal fixing apparatus, a copying paper carrying a toner image is fed between a heater and a pressure roller.

The heater typically has a strip shape. The heater has a strip substrate of heat-resisting alumina ceramics, a thin film heater of silver-palladium alloy coated on the substrate and a protective layer of vitreous film coated on the thin film heater for protecting it from wear caused by the copying paper.

The pressure roller has a rotary shaft aligned in parallel with the heater, a cylinder coaxially mounting the shaft and a sleeve fitted on the cylinder. The sleeve is typically made of a heat resisting elastic material.

The heater is stationary mounted on a suitable base. The pressure roller rotates in rubbing against the heater. Thus, the copying paper carrying the toner image is transmitted through the thermal fixing apparatus. During the transmission of the copying paper, the heater fuses the toner image, while the pressure roller presses the copying paper against the heater. Thus, the toner image is fixed to the copying paper.

In such a heater, the vitreous protective layer has a single edge or peak extending along the longitudinal direction of the substrate. Thus, the heater has a thin line contact with the copying paper or the pressure roller at the single edge or peak of the vitreous protective layer.

Such a thin line contact allows a smooth sliding of the copying paper passing over the heater. However, the thin line contact is disadvantageous or insufficient for fixing the toner image to the copying paper, because such a thin line contact hardly conducts heat to its contacting object, e.g., the copying paper.

SUMMARY OF THE INVENTION

It is, therefore, an object of the present invention to provide a heater which has a high thermal conductivity to its contacting object without damaging the smooth sliding for the contacting object.

Another object of the present invention is to provide a thermal fixing apparatus which is able to cause a good thermal fixation on a fixing object.

In order to achieve the above object, a heater according to one aspect of the present invention includes a substrate, an electrical heating element mounted on the substrate and a protective layer for covering the electrical heating element, the protective layer having a concave contacting edge.

A thermal fixing apparatus according to another aspect of the present invention includes a heater and a pressure roller pressed against the heater. The heater has a substrate, an electrical heating element mounted on the substrate and a protective layer for covering the electrical heating element, the protective layer having a concave contacting edge. The pressure roller is fitted against the concave contacting edge of the protective layer of the heater.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
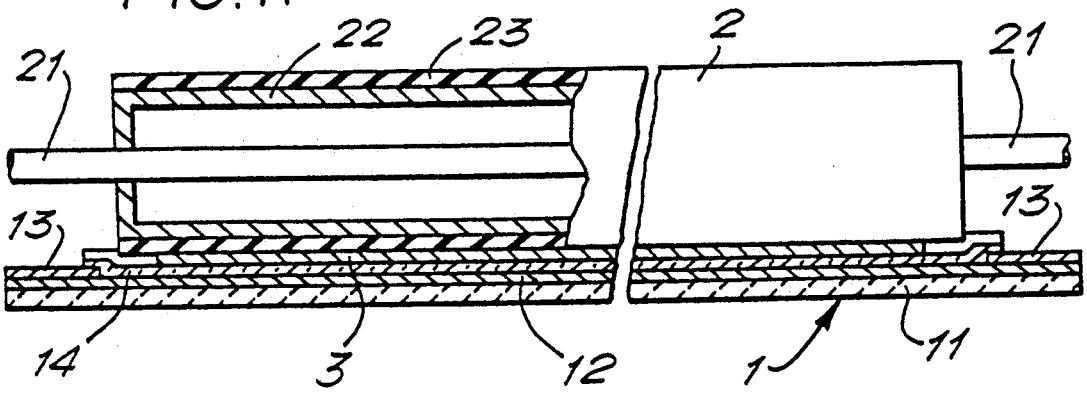
FIG. 1 is a longitudinal section of an embodiment of the thermal fixing apparatus according to the present invention.

The present invention will be described in detail with reference to the FIGS. 1 through 5. Throughout the drawings, like or equivalent reference numerals or letters will be used to designate like or equivalent elements for simplicity of explanation.

Figure 2:
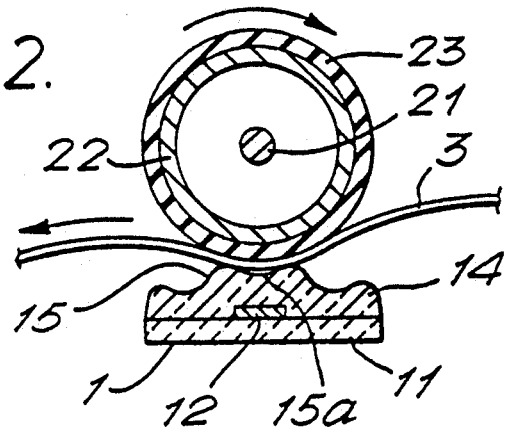
FIG. 2 is cross section of the thermal fixing apparatus of FIG. 1.
Figure 3:
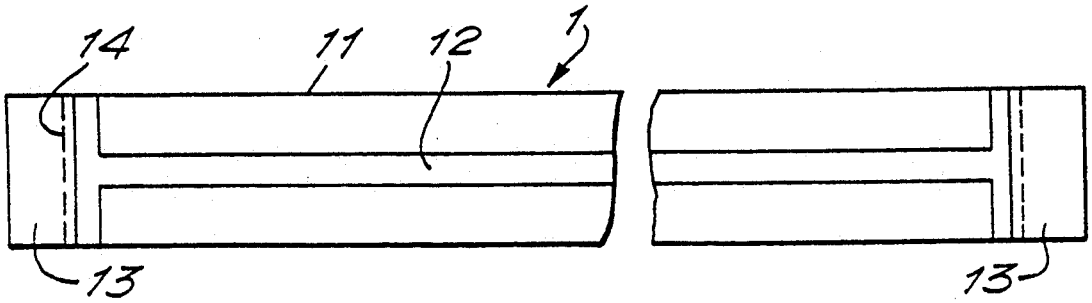
FIG. 3 is a plan view of the heater of FIGS. 1 and 2.
Figure 4:
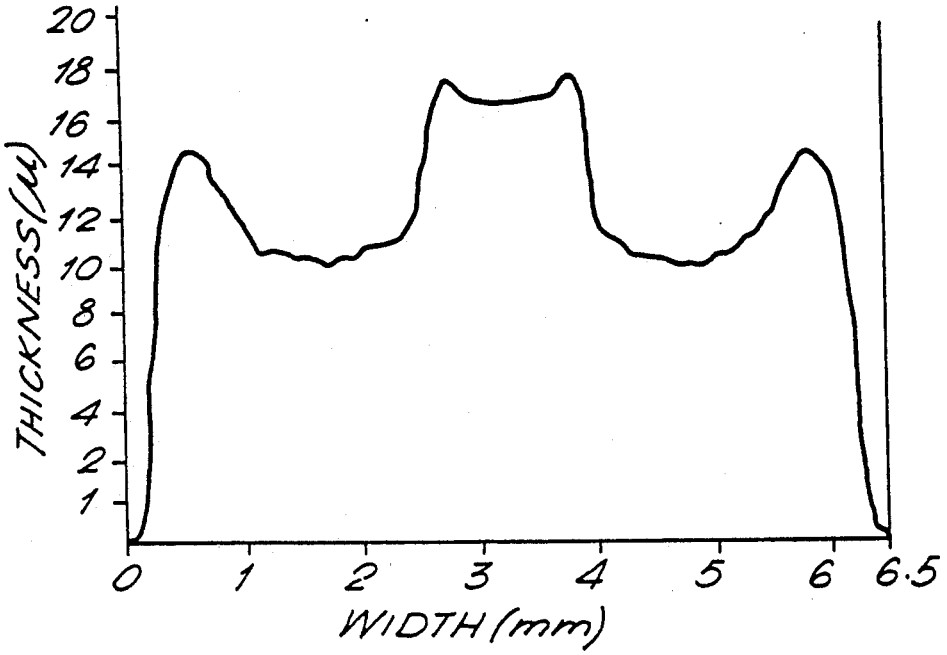
FIG. 4 is a graph showing the thickness of the protective layer plotted on a sample of the heater which is implemented according to the present invention.

Referring now to FIGS. 1 through 4, an embodiment of the thermal fixing apparatus according to the present invention will be described in detail. FIG. 1 shows a longitudinal section of the thermal fixing apparatus. FIG. 2 shows a cross section of the thermal fixing apparatus. FIG. 3 shows a plan view of the heater of FIGS. 1 and 2. FIG. 4 shows the graph plotting the thickness of the protective layer of a sample heater which is implemented according to the present invention.

The thermal fixing apparatus has a strip heater 1 and a pressure roller 2, as shown in FIGS. 1 and 2. Before discussing the detail of the thermal fixing apparatus, the detail of the heater 1 will be discussed in reference to FIG. 3.

The heater 1 comprises a strip substrate 11, a print heater 12 and a vitreous protective layer 14, as shown in FIG. 3.

The substrate 11 is made of alumina ceramics. The print heater 12 is fixed on the substrate 11. The print heater 12 is located at the center across the substrate 11 and extends in the longitudinal direction of the substrate 11. The print heater 12 can be made by a conventional thick film printing technique.

The substrate 11 has a cubic size of 300 mm long, 6.5 mm wide and 1 mm thickness. The print heater 12 has a surface size of 280 mm long and 2 mm wide.

Both ends of the print heater 12 are connected to terminals 13 for electrical connections to a power source. The terminals 13 are positioned on both ends of the substrate 11, respectively. The terminals 13 comprise two layers, i.e., a first layer coated on the substrate 11 and a second layer coated on the first layer. The first layer is made of silver palladium alloy, while the second layer is made of silver.

Referring back to FIGS. 1 and 2, the print heater 12 is covered by the vitreous protective layer 14 except its ends, which are left uncovered for electrical connections. The vitreous protective layer 14 is made of, e.g., Pb0-B203-Si02 glass. The vitreous protective layer 14 has a concave contacting edge 15 extending along the print heater 12. The concave contacting edge 15 has a concave groove 15*a* in its center, as shown in FIG. 2. As a result, the vitreous protective layer 14 has double contacting edges.

The vitreous protective layer 14 covers the entire surface of the print heater 12 and the portions of the terminals 13 next to the ends of the print heater 12, but leaves the large portions of the terminals 13 uncovered.

The concave groove 15*a* of the concave contacting edge 15 has the length of 275 mm. In FIG. 2, the thickness of the vitreous protective layer 14 is exaggerated for explanation. Further, the graph of FIG. 4 shows the surface shape of the vitreous protective layer 14 by the thickness plotted on a sample of the heater 1 which is implemented according to the present invention.

The heater 1 is aligned in parallel to the pressure roller 2, and pressed against thereto. The pressure roller 2 comprises a rotary shaft 21, a cylinder 22 and a sleeve 23. The sleeve 23 is made of a heat resisting elastic material such as silicon rubber. The elastic sleeve 23 can be formed by coating the silicon rubber for a predetermined thickness. The elastic sleeve 23 gives a relative large friction with a copying paper 3, in comparison to a friction between the copying paper 3 and the vitreous protective layer 14 of the heater 1.

The pressure roller 2 is aligned to fit against the concave groove 15*a* of the vitreous protective layer 14. Thus, the heater 1 and the pressure roller 2 fit against each other at a relatively wide line contact therebetween. That is, they contact with each other at a substantial face contact. When a copying paper 3 carrying a toner image is transmitted over the heater 1, the copying paper 3 is pressed against the concave groove 15*a* of the vitreous protective layer 14 by the pressure roller 2. The copying paper 3 contacts the heater 1 at the wide line contact. Thus, the toner image is surely fixed to the copying paper 3 by the heat generated by the heater 1 during the transmission of the copying paper 3.

This wide contact area between the copying paper 3 and the heater 1 brings advantages as follows.

(1) A rise time to start is shortened.

(2) A heat capacity require for fixing the toner image is obtained by a relatively low temperature in comparison to the conventional heater. Thus, the electric power can be saved.

(3) When as much electric power as is normally applied to a conventional heater, the speed of thermal fixation is accelerated.

When the curvature of the concave groove 15*a* agrees with the curvature of the surface of the elastic sleeve 23 of the pressure roller 2, the best condition the heat transfer to the copying paper 3 is obtained.

When the curvature of the concave groove 15*a* is larger than the curvature of the pressure roller 2, in other words, when the surface of the concave groove 15*a* becomes close to a plane, the contacting area between the heater 1 and the copying paper 3 becomes small. When the surface of the concave groove 15*a* is formed as a plane, the contact becomes nearly one line contact and the effect of this invention is almost lost. This causes the advantages of the present invention to be reduced.

On the contrary, when the curvature of the concave groove 15*a* is smaller than the curvature of the pressure roller 2, the bottom of the concave groove 15*a* fails to contact the elastic sleeve 23 of the pressure roller 2. In other words, the heater 1 and the copying paper 3 contact each other at two line contacts. When the curvature the concave groove 15*a* becomes further small, two contacting areas between the heater 1 and the copying paper 3 shift to the openings of the concave groove 15*a* and each contacting area becomes small. This also causes the advantages of the present invention to be reduced. In the latter case, however, the heat transfer efficiency from the heater 1 to the copying paper 3 is better than the conventional heater.

Figure 5:
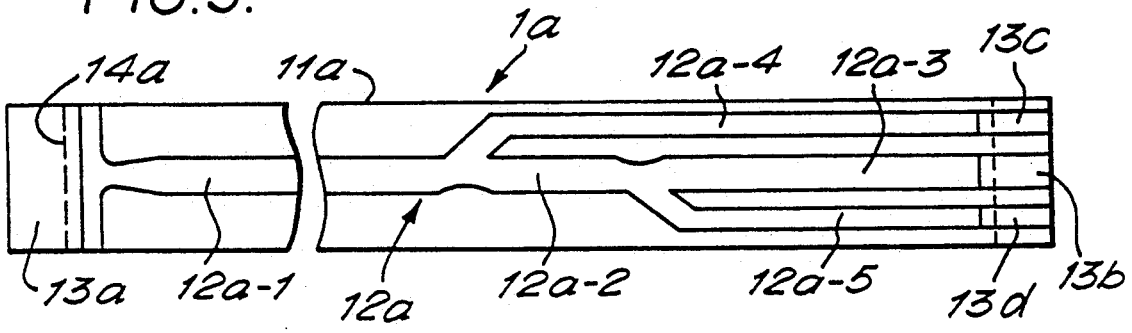
FIG. 5 is a plan view of a modification of the heater of FIG. 3.

Referring now to FIG. 5, a modification of the heater will be discussed. The heater 1*a* of FIG. 5 comprises a strip substrate 11*a*, a print heater 12*a* and a vitreous protective layer 14*a*, similar to the heater 1 of FIG. 3.

The substrate 11*a* and the vitreous protective layer 14*a* are the same as the substrate 11 and the vitreous protective layer 14 of FIG. 3, while the print heater 12*a* has a construction different from the print heater 12 of FIG. 3. Thus, the print heater 12*a* will be discussed, but the discussions of the substrate 11*a* and the vitreous protective layer 14*a* will be omitted below for the simplicity of explanation.

In FIG. 5, the print heater 12*a* comprises five pieces of heater elements 12*a*-1 through 12*a*-5. First to third heater elements 12*a*-1, 12*a*-2 and 12*a*-3, being coupled in series, are located between terminals 13*a* and 13*b* at the center axis of the substrate 11*a*. Thus, the series circuit of the first to third heater elements 12*a*-1, 12*a*-2 and 12*a*-3 faces to the concave groove 15*a* of the concave contacting edge 15 (see FIGS. 1 and 2).

The fourth heater element 12*a*-4 is coupled between the first heater element 12*a*-1 and a terminal 13*c* in parallel to the series circuit of the second and the third heater elements 12*a*-2, 12*a*-3. The fifth heater element 12*a*-5 is coupled between the second heater element 12*a*-2 and a terminal 13*d* in parallel to the third heater element 12*a*-3.

The fourth and fifth heater elements 12*a*-4, 12*a*-5 are located on both sides of the substrate 11*a* by being separated by the series circuit of the first to third heater elements 12*a*-1, 12*a*-2 and 12*a*-3.

The third to fifth heater elements 12*a*-3, 12*a*-4 and 12*a*-5 are coupled to the separated terminals 13*b*, 13*c* and 13*d*. The terminal 13*a* is coupled to one polarity of a power source, while the terminals 13*b*, 13*c* and 13*d* are selectively coupled to the other polarity of the power source.

When both the fourth and fifth heater elements 12*a*-4 and 12*a*-5 fail to be supplied with the power source, only the series circuit of the heater elements 12*a*-1, 12*a*-2 and 12*a*-3 receives a power from the power source so that series circuit uniformly generates heat over it entire length. Thus, the entire length of the heater 1*a* becomes effective for fixing a copying paper with a full width corresponding to the entire length of the heater 1*a*.

When only the fifth heater element 12*a*-5 fails to be supplied with the power source, a current flowing through the print heater 12*a* is divided into two paths, i.e., a path of the fourth heater element 12*a*-4 and another path of a series of the second and third heater elements 12a-2 and 12a-3. This causes a parallel resistance provided by the parallel circuit of the two paths to be decreased in comparison to the resistance of the first heater element 12a-1. Then the first heater element 12a-1 generates a rated heat necessary for fixing a copying paper. But the heat of the parallel circuit of the second to fourth heater elements 12a-2, 12a-3 and 12a-4 is enormously decreased. Thus, only the first heater element 12a-1 becomes effective for fixing a copying paper with a limited width corresponding to the length of the first heater element 12a-1.

When the fourth heater element 12a-4 fails to be supplied with power source, the current flowing through the print heater 12a is divided into other two paths, i.e., a path of the fifth heater element 12a-5 and another path of the third heater element 12a-3. This causes a parallel resistance provided by the parallel circuit of the other two paths to be decreased in comparison to the resistances of the first and second heater elements 12a-1 and 12a-2. Then the first and second heater elements 12a-1 and 12a-2 generate the rated heat necessary for fixing a copying paper. But the heat of the parallel circuit of the heat of the parallel circuit of the third and fifth heater elements 12a-3 and 12a-5 is enormously decreased. Thus, a portion of the series circuit, i.e., only the first and second heater elements 12a-1 and 12a-2 become effective for fixing a copying paper with a limited width corresponding to the length of the first and second heater elements 12a-1 and 12a-2.

In the second embodiment of the heater, the concave groove 15a may be extend over the fourth and fifth heater elements 12a-4 and 12a-5.

As described above, the present invention can provide an extremely preferable thermal fixing apparatus and a heater for use therefor.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. A heater for a thermal fixing apparatus which uses a substantially cylindrical pressure roller extending in a longitudinal direction from one end to another end, said heater comprising:

a substrate having two ends, between which said longitudinal direction is defined, said cylindrical pressure roller extending in said longitudinal direction;

a single continuous electrical heating element mounted on the substrate and extending in the longitudinal direction, in parallel with the longitudinal direction in which the pressure roller extends, from one end of the substrate to the other end; and a protective layer directly covering the electrical heating element and having a raised contacting edge, the contacting edge having a concave groove which is substantially flat in cross section in the longitudinal directional in an effective area of heating thereof.

2. A heater as claimed in claim 1, wherein the heating element has a strip shape with an axis, and the concave groove extends along the axis facing the heating element.

3. A heater as claimed in claim 2, wherein the heating element comprises a first resistive element having a predetermined effective resistance.

4. A heater as claimed in claim 3, further comprising means for decreasing the effective resistance of the first resistive element.

5. A heater comprising:

a substrate;

an electrical heating element mounted on the substrate, the electrical heating element being a strip shape having a longitudinal axis and comprising a first resistive element having a predetermined effective resistance;

means for decreasing the effective resistance of a first portion and a second portion of the first resistive element, the decreasing means including second and third resistive elements, the effective resistance of the first portion of the first resistive element decreasing when the second resistive element is coupled in parallel with the first portion of the first resistive element and the effective resistance of the second portion of the first resistive element decreasing when the third resistive element is coupled in parallel with a third portion of the first resistive element; and a protective layer covering the electrical heating element and having a raised contacting edge, the contacting edge having a concave groove, extending along the longitudinal axis facing the heating element.

6. A heater as claimed in claim 5, wherein the concave groove extends over the first, the second and the third resistive elements.

7. A heater as claimed in claim 5, wherein the protective layer has a vitreous layer.

8. A thermal fixing apparatus as in claim 6, further comprising:

a pressure roller pressed against the heater and fitting against the concave contacting edge of the protective layer of the heater.

9. A thermal fixing apparatus as claimed in claim 8, wherein the curvature of the pressure roller substantially agrees with the curvature of the concave groove.

10. A thermal fixing apparatus as claimed in claim 8, wherein the pressure roller has an elastic sleeve for fitting against the concave contacting edge.

11. A thermal fixing apparatus comprising:

a pressure roller, having at least a portion of which is substantially arcuate in cross section, said pressure roller having a length extending in a first direction;

a substrate, having two ends, between which said pressure roller extends;

a heater, adapted to receive electrical current and produce heat based thereon, mounted on the substrate extending in a direction parallel to said first direction and extending from one end of the substrate to the other end; and a protective layer covering said heater and disposed between said heater and said pressure roller, said protective layer having a surface facing said pressure roller and pressed against said pressure roller, said surface having a raised contacting edge, which has a concave shape which corresponds to a shape of the surface of the pressure roller and which is flat in longitudinal shape in an effective area of heating thereof.

12. A heater as in claim 1 wherein said substrate is longer than a length of said cylindrical pressure roller.

* * * * *